US005181618A

United States Patent [19]

Pogue

[11] Patent Number: 5,181,618

[45] Date of Patent: Jan. 26, 1993

[54] APPARATUS FOR CLEARING THE WEIGH PAN OF A PARTICLE SIZE ANALYZER

[75] Inventor: Glenn J. Pogue, Cincinnati, Ohio

[73] Assignee: Rotex, Inc., Cincinnati, Ohio

[21] Appl. No.: 721,181

[22] Filed: Jun. 26, 1991

[51] Int. Cl.[5] ..... B07B 13/14

[52] U.S. Cl. ..... 209/239; 209/237; 177/145; 177/262; 222/342; 222/409; 222/517; 414/411; 414/417

[58] Field of Search ..... 209/236, 237, 239, 933, 209/255, 259, 258; 222/342, 409, 517, 77, 322; 414/21, 411, 417; 177/145, 146, 262

[56] References Cited

U.S. PATENT DOCUMENTS

| | | | |
|---|---|---|---|
| 2,334,337 | 11/1943 | Lawry et al. | 222/409 X |
| 2,893,602 | 7/1959 | Barber et al. | 222/409 X |
| 3,258,164 | 6/1966 | Stradling | 177/145 X |
| 4,487,323 | 12/1984 | Marrs | 209/683 X |
| 4,591,012 | 5/1986 | Moran | 177/262 |
| 4,718,578 | 1/1988 | Radek et al. | 222/517 X |
| 4,797,204 | 1/1989 | Lower et al. | 209/237 |

FOREIGN PATENT DOCUMENTS

| | | | |
|---|---|---|---|
| 656536 | 6/1928 | France | 222/322 |
| 752588 | 7/1956 | United Kingdom | 222/342 |

*Primary Examiner*—Donald T. Hajec

*Attorney, Agent, or Firm*—Wood, Herron & Evans

[57] ABSTRACT

An apparatus for automatically removing particulate matter from a weighing pan of a particle-size analyzer. The apparatus includes a weighing pan having a hinged door to provide a discharge outlet for the particular matter and a wiper blade assembly for clearing the particulate matter from the weighing pan. The apparatus further includes a driving mechanism, preferably a rodless cylinder, for operating the wiper assembly in the weighing pan.

16 Claims, 2 Drawing Sheets

APPARATUS FOR CLEARING THE WEIGH PAN OF A PARTICLE SIZE ANALYZER

FIELD OF INVENTION

This invention relates to discharge apparatus, and more particularly to apparatus for discharging particulate matter from a weighing device in an automatic particle-size analyzer.

BACKGROUND OF THE INVENTION

Particle-size analysis is a standard type of industrial test which is performed on a wide variety of materials. Many bulk particulate items of commerce are sold according to some predetermined particle size requirement or classification. In addition, size classification data is frequently used as a control in various manufacturing processes. Such classification is usually referred to as a "screen analysis," a term chosen from the laboratory method of determining the particle size distribution of a sample. In that type of analysis, the sample to be analyzed is sifted on or through a plurality of sequentially graded screens (rom coarser to finer) and thereby divided into a plurality of size fractions. The size fractions are weighed and those weights are used to calculate a particle size or screen analysis, which is typically expressed in terms of the weight percentages of the size ranges retained on the respective screens.

Particle-size analyzers are commercially available. Rotex, Inc. sells an automatic particle-size analyzer under the trademark GRADEX, and U.S. Pat. Nos. 4,487,323 and 4,797,204 show polygonal drum-type automatic particle-size analyzers. A feature of automatic particle-size analyzers is a weighing scale which receives the sequential size fractions from the screening portion of the analyzer and indicates the weight thereof for use in calculating the particle size distribution of the sample. Once the size distribution analysis has been completed, the sample must be removed or cleared from the scale prior to the next analysis. Heretofore, this has been accomplished by manually removing the scale weighing pan and emptying the contents thereof and/or sweeping the contents from the pan. Such procedures are cumbersome, time consuming and inefficient. There is clearly a need for an efficient, expeditious means for clearing particulate matter from the weighing pans in automatic particle-size analyzers.

SUMMARY OF THE INVENTION

In its broadest aspects, the present invention is directed to an apparatus for automatically clearing particulate matter from a weighing pan.

In a preferred embodiment, the apparatus includes a support structure for supporting a scale, which in turn supports the weighing pan. The weighing pan includes a discharge outlet and a wiper assembly designed to clear the particulate material from the pan by directing it through the discharge outlet. The apparatus further includes a mechanism, selectively engageable with the wiper assembly, for driving or moving the wiper assembly to clear the pan. Additionally, the support structure preferably includes means, such as lift cylinders, for lifting the weighing pan off the scale and bringing the driving mechanism into engagement with the wiper assembly.

In a preferred method of operation, the weighing pan receives particulate matter from an associated particle size analyzer, for example, a GRADEX analyzer. In accordance with known technique, the scale upon which the pan rests records the weights of the respective size fractions and calculates the size-analysis of the sample. Once all the fractions have been receive in the pan and their weights recorded, the apparatus of the present invention is activated, either manually or automatically. The lift cylinders lift the weighing pan off the scale a sufficient distance so that the wiper assembly and the driving mechanism (preferably a rodless cylinder) are engaged. The driving mechanism is then activated (either manually or automatically) and drives or moves the wiper assembly the length of the weighing pan such that all or substantially all of the particulate material in the pan is pushed toward and through the discharge outlet. The driving mechanism then retracts the wiper assembly to its original position and the lift cylinders lower the pan back onto the scale, thus disengaging the driving mechanism and the wiper assembly.

More specific details and advantages of the present invention will become further apparent to those skilled in the art upon reading the detailed description in conjunction with the drawings.

DETAILED DESCRIPTION OF THE INVENTION

Figure 1:
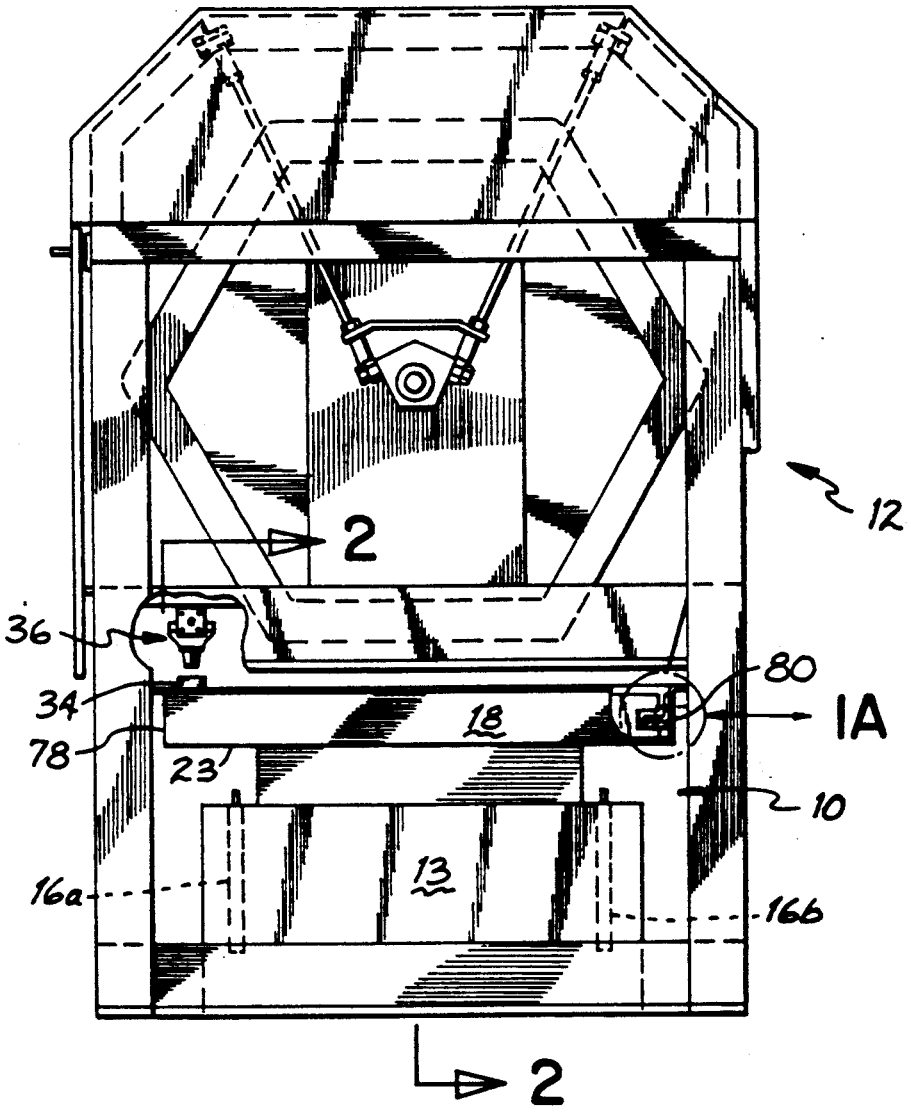
FIG. 1 is an end view, partially broken away, of a polygonal drum-type particle size analyzer including the apparatus of the present invention.

FIG. 1 shows apparatus 10 of the present invention in one contemplated operative environment; i.e., in combination with a polygonal drum-type particle size analyzer 12 such as is described in U.S. Pat. Nos. 4,487,323 and 4,797,204. It should be understood, however, that apparatus 10 can be used in combination with other types of particle size analyzers (whether or not automatic) wherein the particulate matter is collected on a pan tray or platform for weighing.

Figure 2:
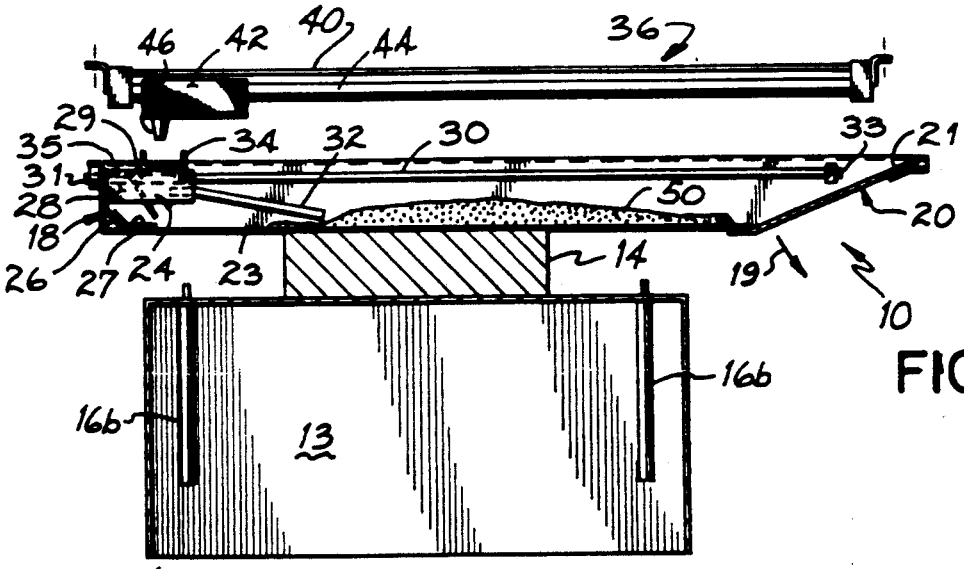
FIG. 2 is a vertical section taken on line 2—2 of FIG. 1 and shows the apparatus of the present invention in a first operational position.

The details of apparatus 10 will now be described with specific reference to FIGS. 2–4. In a preferred embodiment, apparatus 10 includes a support structure 13 for supporting a suitable weighing scale 14, which may be conventional. Support structure 13 preferably includes four lifting means in the form of cylinders at the corners of the scale (only two of which are shown, **16*a* and 16*b* in FIG. 1), the purpose of which will be described in detail below. It will be appreciated that the embodiment of the apparatus shown will include at least one suitably postioned lifting cylinder. Scale 14 supports weighing pan 18, as shown in FIG. 2, which is designed to receive particulate matter from the particle size analyzer (see FIG. 1). It will be appreciated that scale 14 and weighing pan 18** may comprise an integral unit, in which case the scale would be considered an element of the present invention.

Weighing pan 18 is preferably generally rectangular and has an upwardly sloping end wall 20 which is hinged at its upper end 21 and connected at its lower end 25 to pan 18 by means of a suitably sized coil spring 70, and designed to open in the direction of arrow 19 in FIG. 2, to provide a hinged outlet door. Spring 70 retains wall or door 20 in a closed position as shown in FIGS. 2 and 3. As shown in FIG. 4, when hinged door 20 is swung away, discharge outlet 22 is opened. It is through discharge outlet 22 that the particulate matter in weighing pan 18 is discharged, preferably into a chute or onto a conveyor (not shown). Receiving pan 18 further includes a wiper assembly 24 which serves to clear pan 18 by pushing the particulate matter along bottom surface 23 of pan 18 toward hinged door 20 and out through discharge outlet 22, as shown in FIG. 4. It will be appreciated that other discharge outlet configurations could be utilized in the apparatus of the present invention. It will also be appreciated that wiper assembly 24 need not clear pan 18 of all the particulate matter, but must clear a sufficient amount so that pan 18 does not reach its capacity during a subsequent weighing operation.

Figure 1A:
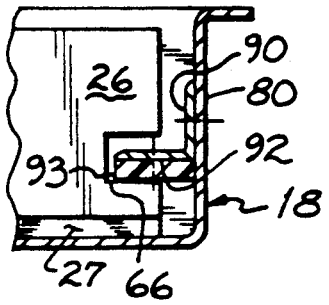
FIG. 1A is an enlarged view of encircled portion of FIG. 1.

Wiper assembly 24 consists of a wiper blade support member 28 having a downwardly and forwardly angled wiper blade 26, and may include flexible wiper strip 27, which clears the particulate matter from pan 18. Blade support 28 has a bore 29 therethrough for receiving longitudinal guide rod 30, which is secured to pan 18 at its ends 31 and 33. Blade support 28 slides freely on guide rod 30 which guides wiper assembly 24 as it traverses and cleans pan 18. Guide rod 30 is located adjacent one side wall 78 of pan 18. As shown in FIG. 1A, side wall 80 (which is opposite side wall 78) has an L-shaped angle bracket 90 attached thereto by any suitable means, e.g., a bolt (not shown). The underside 92 of bracket 90 has a slide surface 93 of ultra-high molecular weight polyethylene. The end portion of wiper blade 26 has a channel 66 which receives bracket 90 and slides freely as wiper assembly 24 is driven in the clearing operation. By utilizing guide rod 30 at one end and bracket 90 at the opposite end as supports and guides for wiper assembly 24, binding during the clearing operation is minimized.

Projecting forwardly and slightly downwardly from support 28 is a push rod member 32 which precedes (spatially) wiper blade 26 and engages and pushes hinged door 20 to its open discharge position (shown in FIG. 4) as the wiper advances, thus opening discharge outlet 22. Wiper assembly 24 further comprises a transverse, generally U-shaped bracket 34, or other suitable means, affixed to upper surface 35 of blade support 28 for engaging drive mechanism 36, as will be described below. It will be appreciated that, alternatively, the wiper blade may be integral with the drive mechanism, rather than forming a part of the pan 18.

Drive mechanism 36 preferably includes a rodless cylinder 40 which may itself be of known type. One suitable band cylinder is Model BC100-100, sold by Tol-O-Matic of Minneapolis, Minn. Rodless cylinder 40 includes member 42 which travels longitudinally along cylinder 44. Member 42 includes a downwardly projecting pin 46 for engaging U-shaped bracket 34 when discharge apparatus 10 has been lifted to its operational position shown in FIG. 3. Drive mechanism 36 then drives wiper assembly 24, as shown in FIG. 4.

Figure 3:
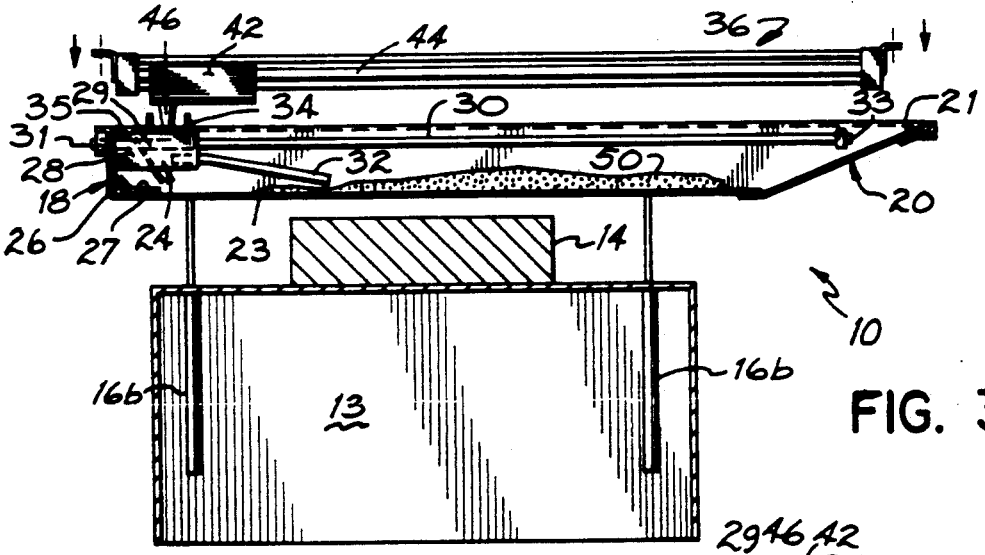
FIG. 3 is a vertical section similar to FIG. 2 but shows the apparatus in a second operational position.
Figure 4:
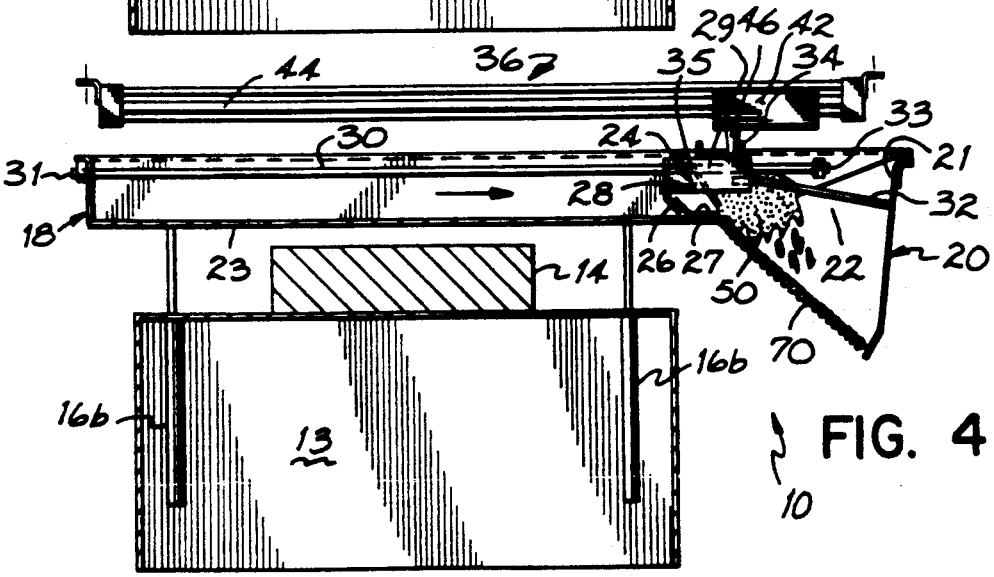
FIG. 4 is a vertical section which shows the apparatus in a third operational position.

The mode of operation of apparatus 10 is shown in FIGS. 2–4. In FIG. 2, weighing pan 18 rests on scale 14 and receives a particulate matter sample 50. When it is desired at least partially to clear sample 50 from pan 18, apparatus 10 is activated, either manually or automatically. In a first step, lift cylinders **16*a* and 16*b* are pressurized to raise pan 18 off scale 14 as shown in FIG. 3. It will be appreciated that means other than lift cylinders could be used to lift pan 18 off of scale 14. Lift cylinders 16*a* and 16*b* raise pan 18 until U-shaped bracket 34 of wiper assembly 24 straddles the depending pin 46 of band cylinder 40**.

Band cylinder 40 is then activated and drives wiper assembly 24 along guide rod 30 such that wiper blade 26 pushes sample 50 toward hinged door 20 of receiving pan 18. As wiper assembly 24 approaches hinged door 22, push rod member 32 engages and urges hinged door 20 open and sample 50 is discharged through discharge outlet 22, as shown in FIG. 4. At the end of its stroke, band cylinder 40 automatically reverses and drives wiper assembly 24 back to its original position (i.e., that shown in FIG. 2) and spring-loaded, hinged door 20 automatically closes. Subsequently, lift cylinders **16*a* and 16*b* lower pan 18 onto scale 14** in preparation for receiving the next sample.

Activation and operation of lift cylinders **16*a* and 16*b* and band cylinder 40** may be accomplished automatically by a central control system, not shown, or may be accomplished by manual activation at the appropriate time.

Further, pan 18 may be lifted off scale 14 and raised into sealing contact with the underside of the particle size analyzer each time a new particle size fraction is discharged from the analyzer. This proves especially useful when the particulate matter is very fine and dusty and thus serves to prevent loss of material prior to the weighing operation.

It will be appreciated by those skilled in the art that variations on the specific details of the present invention are contemplated without departing from the scope of the invention, which is defined by the following claims.

What is claimed is:

1. Apparatus for clearing the weigh pan of a particle size analyzer, comprising:

a pan for receiving a sample of particulate matter, said pan including a discharge outlet through which the particulate sample can be discharged;

wiper means for moving the particulate sample out through said discharge outlet;

means for driving said wiper means to so move the particulate sample from said pan; and means for raising and lowering said pan to engage and disengage said drive means.

2. The apparatus of claim 1 wherein said pan further includes means for guiding said wiper means as it is driven.

3. The apparatus of claim 2 wherein said pan has a hinged end wall defining said discharge outlet.

4. The apparatus of claim 3 wherein said hinged end wall includes spring means to maintain said end wall in a closed position until urged to an open position thereby opening said discharge outlet.

5. The apparatus of claim 4 wherein said wiper means includes a wiper blade support member which rides on said guide means and a wiper blade extending generally downwardly from said blade support member for pushing the particulate sample.

6. The apparatus of claim 5 wherein said wiper means further includes a push rod member extending forwardly of said blade support member for engaging and urging said hinged door to an open position.

7. The apparatus of claim 1 wherein said raising and lowering means comprises at least one lift cylinder.

8. The apparatus of claim 1 wherein said drive means comprises a band cylinder and includes means for engaging said wiper means with said band cylinder.

9. In a particle-size analyzer including a scale and means for supplying a particulate matter sample to said analyzer for analysis, the improvement comprising apparatus for clearing the weigh pan of the particle size analyzer comprising:

a pan for receiving a sample of particulate matter, said pan adapted to rest o n the scale and including a discharge outlet through which the particulate sample can be discharged;

wiper means for pushing the particulate sample out through said discharge outlet;

means for driving said wiper means to push the particulate sample from said receiving pan; and means for raising and lowering said pan off and on the scale, respectively, to engage and disengage said drive means.

10. The apparatus of claim 9 wherein said pan further includes means for guiding said wiper means as it is driven.

11. The apparatus of claim 10 wherein said pan has a hinged end wall defining said discharge outlet.

12. The apparatus of claim 11 wherein said hinged end wall includes spring means to maintain said end wall in a closed position until urged to an open position thereby opening said discharge outlet.

13. The apparatus of claim 12 wherein said wiper means includes a wiper blade support member which rides on said guide means and a wiper blade extending generally downwardly from said blade support member for pushing the particulate sample.

14. The apparatus of claim 13 wherein said wiper means further includes a push rod member extending forwardly of said blade support member for engaging and urging said hinged door to an open position.

15. The apparatus of claim 9 wherein said raising and lowering means comprises at least one lift cylinder.

16. The apparatus of claim 9 wherein said drive means comprises a band cylinder and includes means for engaging said wiper means.

* * * * *